United States Patent [19]

Buettner

[11] Patent Number: 4,940,039

[45] Date of Patent: Jul. 10, 1990

[54] CUTTING TOOL

[76] Inventor: Rudolf Buettner, Schelde-Lahn-Strasse 8, D-6345 Eschenburg 4, Fed. Rep. of Germany

[21] Appl. No.: 391,678

[22] Filed: Aug. 8, 1989

Related U.S. Application Data

[63] Continuation of Ser. No. 180,403, Apr. 12, 1988, abandoned.

[30] Foreign Application Priority Data

Apr. 16, 1987 [DE] Fed. Rep. of Germany ..... 3712953

[51] Int. Cl.[5] ..... B28D 1/04

[52] U.S. Cl. ..... 125/15; 51/206 P

[58] Field of Search ..... 51/206 R, 206 P, 206.4, 51/207, 283 R; 125/15, 18

[56] References Cited

U.S. PATENT DOCUMENTS

| | | | |
|---|---|---|---|
| 1,965,384 | 7/1934 | Legge | 51/207 X |
| 2,049,874 | 8/1936 | Sherk | 51/206 P |
| 3,023,551 | 3/1962 | Osenberg | 51/207 |
| 3,049,843 | 8/1962 | Christensen | 51/206 |
| 3,127,887 | 4/1964 | Metzger | 125/15 |
| 3,371,452 | 3/1968 | Mabey | 51/206 |
| 3,711,999 | 1/1973 | Held | 51/206 |
| 3,742,655 | 7/1973 | Oliver | 51/356 |

FOREIGN PATENT DOCUMENTS

| | | | |
|---|---|---|---|
| 364490 | 12/1921 | Fed. Rep. of Germany | 51/206 R |
| 22500 | 7/1921 | France | 51/206 P |
| 633633 | 2/1928 | France | 51/206 P |
| 894614 | 12/1944 | France . | |
| 1104941 | 11/1955 | France . | |
| 1232580 | 10/1960 | France . | |
| 2168063 | 8/1973 | France . | |
| 523879 | 7/1940 | United Kingdom . | |

*Primary Examiner*—Robert P. Olszewski

*Attorney, Agent, or Firm*—Flynn, Thiel, Boutell & Tanis

[57] ABSTRACT

A cutting tool comprising a disk, on the periphery of which are mounted cutting segments. The cutting elements have grooves which extend over the entire height of each cutting segment and have channels discharging chip material in peripheral direction. The latter are in particular meander-shaped, zigzag-shaped or wave-shaped, with the cutting-segment surfaces being opposite one another conformingly parallel in such a manner that a full cross-sectional overlapping is assured in an axial direction. Side channels and/or V-channels can follow a center channel in order to also permit a lateral material discharge.

6 Claims, 1 Drawing Sheet

CUTTING TOOL

This application is a continuation of Ser. No. 180,403, filed Apr. 12, 1988, now abandoned.

FIELD OF THE INVENTION

The present invention relates to a cutting tool for cutting of natural stone, concrete, ceramics and the like.

BACKGROUND OF THE INVENTION

Such cutting tools have usually metallic disks, the diameter of which may be up to 4 m. Cutting segments are mounted on the periphery of the disk, which cutting segments have industrial diamonds in a holding mass. The width of the diamond segments determines the cutting width.

Attempts have been made to increase the cutting performance through longer cutting segments, thus through a higher proportionate filing of the peripheral surface of the disk. This, however, is influenced by the chip material between the workpiece and the outer peripheral surface of the cutting segment having to again be discharged. The cutting segment is for this purpose provided with flat grooves on the outside, which flat grooves do not evenly discharge the chip material. Thus a high amount of frictional heat is created. Both circumstances effect an accelerated removal of the binding agent for the diamond grains, so that same break off and an increased wear occurs. One is therefore forced to find a compromise between the embedding strength of the binding agent and the rate at which material is removed.

Thus a need for improved cutting tools exists. An important goal of the invention is to overcome the disadvantages of the state of the art and to further develop a cutting tool of the above-mentioned type with economical measures in such a manner that the cutting performance is increased and the chip material is discharged quickly without causing the wear on the tool to be increased.

The cutting segments have, according to the invention, at least one channel extending over their height, which channel helps to discharge the chip material. The course of the channel or of the channels can be substantially wave-shaped, zigzag-shaped or meander-shaped in peripheral direction, however, it is also intended to construct the channel or each channel as a deep groove which extends inclined or curved. Several grooves can be arranged parallel or rather equidistant to one another; groups of grooves can intersect, in particular at an acute angle. Thus, the invention provides good transporting paths for the discharge of the chip material, while a higher cutting performance is simultaneously achieved. The special design of the cutting segments further causes a reduced friction to occur on the side surfaces of the cutting segments so that, accordingly, less frictional heat is created and the created cut has smoother contours than is achievable with common, strong friction generating cutting segments. In addition, the inventively provided channels effect an improved cooling of the cutting segments, which results in a longer tool life.

The designs of the cutting segments and their channels serve to further increase the cutting performance with an improved material discharge which takes place both in a peripheral direction and also transversely thereto. In particular, in the case of serrated or toothed cutting segments, there occurs only an edge friction on the outer sides, however, in spite of this, a holohedral cut is still assured. Important is such a reciprocal form interfitting of the individual cutting pieces of each cutting segment so that no gap exists in axial direction, but that a full cross-sectional overlapping exists. In particular, if the channels in relationship to the peripheral direction form a herringbone structure, the removed material is discharged satisfactorily continuously in flow direction, namely largely in peripheral direction and partly also inclined thereto, that is, directed toward the side surfaces of the cutting gap. Same has a very clean groove extent. The individual cutting segments may also be longer due to a better cooling, so that the peripheral surface of the disk is percentagewise more densely occupied. An even cutting action is thereby assured over the entire length of the cutting segments. Smaller cutting forces are created because of the reduced friction. This relieves the disk and thus it can be designed thinner.

BRIEF DESCRIPTION OF THE DRAWINGS

Further characteristics, details and advantages of the invention will be apparent to those of ordinary skill in the art from the following description of exemplary embodiments in connection with the drawing, in which.

DETAILED DESCRIPTION

Figure 1:
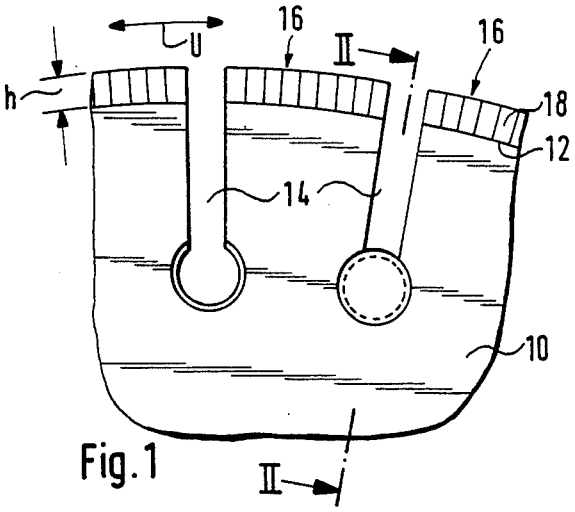
FIG. 1 is a side view of a section of a cutting tool.
Figure 2:
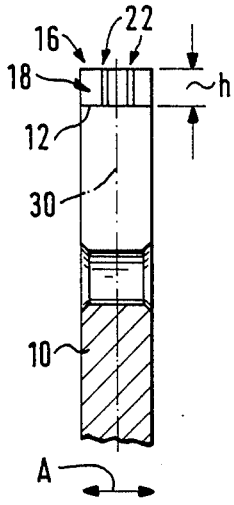
FIG. 2 is a view corresponding with the cross-sectional line II—II of FIG. 1.
Figure 3:
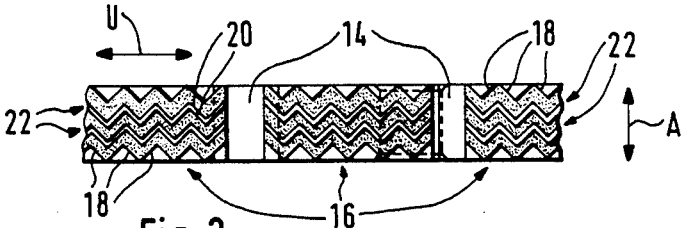
FIG. 3 is a top view of the cutting tool of FIG. 1.

The cutting tool illustrated sectionally in FIGS. 1 to 3 has a disk 10 having radial grooves or slots 14 in its periphery. The grooves 14 separate individual cutting segments 16 from one another.

Each cutting segment has alternating grooves 18 and apex parts 20. Longitudinal channels 22 are thus formed in the peripheral direction U. The surfaces of the cutting pieces are thereby substantially parallel and opposingly conforming to one another at such a distance that no gaps exist in a direction parallel to an axial direction A, but yet a full cross-sectional overlapping exists. FIGS. 1 and 2 show that both the cutting pieces and also the channels 22 of the cutting segments each extend over their entire height h.

Figure 4:
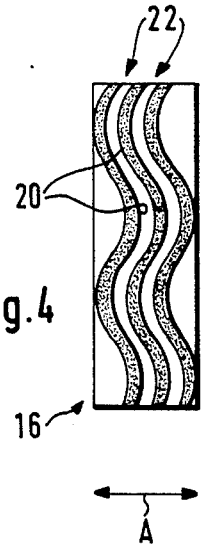
FIG. 4 is a top view of another cutting segment.

Differing from the embodiment illustrated in FIG. 3, the cutting-segment surfaces can also be formed asymmetrically, for example they may have a saw-tooth shape. FIG. 4 illustrates another embodiment. The longitudinal channels 22 are here wave-shaped, so that softer transitions exist which can help the material discharge. The design is here also chosen such that the alternately opposite apex parts 20 assure a full cross-sectional overlapping in the axial direction A.

Figure 5:
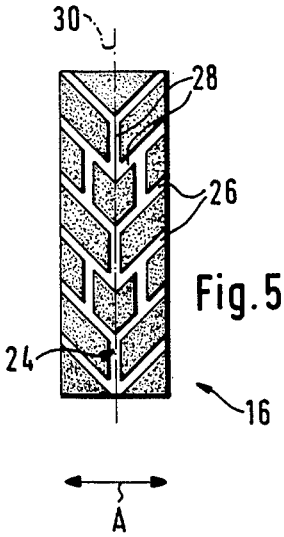
FIG. 5 is a top view of a further modified embodiment of a cutting segment.

FIG. 5 illustrates still another exemplary embodiment. The here illustrated cutting segment 16 has, aside from a middle channel 24, which lies in the center plane 30 of the disk 10 (not illustrated here), inclined side channels 26 and V-channels 28. One recognizes that such cutting segments 16 have a herringbone structure, through which chip material can be particularly well discharged both in a peripheral direction and also inclined thereto. Since the individual cutting pieces have the same design over the entire height (h), an even cutting path is also assured when the effective height becomes smaller and smaller with increasing wear.

Important advantages of the invention are based, on the one hand, on less frictional heat being created due to a reduced amount of edge friction and, on the other hand, on this frictional heat being discharged satisfactorily continuously due to the channel systems in each cutting segment. This contributes substantially to an increased tool life, an increase in the cutting performance and a smoother cutting-surface path.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A cutting tool for cutting of natural stone, concrete, ceramics and the like, comprising:

a very large diameter disk having means defining a plurality of circumferentially spaced cutting segments on the periphery of said disk, said cutting segments being separated by means defining radially outwardly opening and axially opening grooves adapted to receive chip material so that it can be discharged during a cutting operation, said cutting segments each having a circumferentially extending length and means thereon for defining at least a pair of cutting pieces with the entire length of each cutting piece, including axially oppositely facing sidewalls thereof, having a uniform axial thickness and at least one of a wave-shape, or zig-zag-shape in the circumferential direction, mutually adjacent and opposing axially facing cutting piece surfaces being spaced from one another to define a radially outwardly opening, continuous circumferentially extending channel therebetween, means on each cutting piece defining plural apex portions and plural grooved portions alternately spaced along the length of each cutting piece, said apex portions on one side of one cutting piece being received in said grooved portions on a side of the other cutting piece facing said one side to thereby provide a blockage to the otherwise unobstructed continuity of said circumferentially extending channel in a plane of rotation of said disk.

2. The cutting tool according to claim 1, wherein at least three cutting pieces are provided for defining at least two channels which are arranged parallel and equidistant to each other.

3. The cutting tool according to claim 1, wherein said mutually adjacent and opposing cutting piece surfaces extend conformingly parallel to each other and are free of transversely extending channels therethrough.

4. A cutting tool for cutting of natural stone, concrete, ceramics and the like, comprising:

a very large diameter disk having means defining a plurality of circumferentially spaced cutting segments on the periphery of said disk, said cutting segments being separated by means defining radially outwardly opening and axially opening grooves adapted to receive chip material so that it can be discharged during a cutting operation, said cutting segments each having a circumferentially extending length and means thereon defining a plurality of upstanding and independent cutting pieces oriented side-by-side, mutually adjacent and opposing surfaces on said side-by-side and independent cutting pieces being spaced from one another to define a meandering array of interconnected, radially outwardly opening first and second channels therebetween, said first channels extending at a transverse angle to said plane of rotation of said disk and being divided into two groupings, a first of said groupings being oriented on one side of a central plane of rotation of said disks, a second of said groupings being oriented on a side of said central plane of rotation opposite to said one side, all of said first channels in said first grouping extending parallel to each other and at a common acute angle to said central plane of rotation, and all of said second channels extending parallel to said central plane of rotation, at least one of said cutting pieces providing a blockage to otherwise unobstructed circumferential continuity of said second channels thereby causing said first and second channels, in a direction between said radially outwardly opening and axially opening grooves, to meander the length of said cutting segment as well as exiting to the axially facing sides of said cutting segment.

5. The cutting tool according to claim 4, wherein said first channels form a herringbone pattern when viewed from a radial edge of said disk.

6. The cutting tool according to claim 4, wherein said mutually adjacent and opposing cutting piece surfaces extend conformingly parallel to each other.

* * * * *